United States Patent [19]

Grant

[11] Patent Number: 4,619,602

[45] Date of Patent: Oct. 28, 1986

[54] FAIL SAFE AUTOMATIC FLUE DAMPER MECHANISM

[76] Inventor: David M. Grant, 1 Autumn Court, Windsor, Ontario, Canada, N9E 1R2

[21] Appl. No.: 691,471

[22] Filed: Jan. 14, 1985

[51] Int. Cl.[4] ..... F23N 5/02

[52] U.S. Cl. ..... 431/20; 236/1 G; 431/21

[58] Field of Search ..... 236/1 G, DIG. 2, DIG. 5, 236/96; 126/287.5, 285 B; 431/20, 21

[56] References Cited

U.S. PATENT DOCUMENTS 4,102,629 7/1978 Feinberg ..... 431/21 X 4,266,929 5/1981 Swenson ..... 236/1 G

*Primary Examiner*—William E. Wayner

[57] ABSTRACT

The present invention is an electronically controlled, automatically operated flue damper mechanism which is totally fail safe in operation. The mechanism is to be fitted within the draft hood of a thermostatically controlled heating device such as a gas or oil fired furnace. The electronic control circuitry of the damper being integrated with that of the heating device to which it is fitted. The action of the damper being to close the flue a sufficient time after combustion has stopped, to allow all noxious gases from combustion to have left the flue, and to open the flue before combustion can begin.

2 Claims, 4 Drawing Figures

FAIL SAFE AUTOMATIC FLUE DAMPER MECHANISM

The invention concerns the need to open and close a flue from an automatically controlled fuel burning heating device such as a gas furnace, in a totally fail safe manner. The need arises with the necessity to conserve fuel supplies. This is achieved by closing the flue a short time after combustion has stopped, in order to allow all noxious gases to have left the flue. Thereby containing any residual heat from within the furnace, within the building in which it is located and keeping the flue closed when it is not required to be open, winter or summer, thereby containing conditioned air within the building. The flue is opened before combustion can take place.

Many previous attempts have been made to overcome all the problems associated with the damper mechanisms, none of which have succeeded. In most previous designs the damper is located in the fluie, a factor which creates its own problems. Some systems utilizing this design may be seen in U.S. Pat. Nos. 3,010,451: 4,108,369: 4,225,080: 4,290,552, some of those problems being: the possibility of noxious gases escaping from the flue at the point which the damper mechanism enters it: to transmit high heat levels to the control and or operating mechanism thereby introducing a fatigue factor and eventual breakdown of the parts, creating a serious safety hazard: to allow a build up of waste deposits from flue gases on the damper and other parts of the mechanism in the flue, creating maintenance and operating problems. Some previous designs employ springs or bimetal elements to open or close the damper, again fatigue will overtake these springs and bimetal elements possibly rendering them useless, and the damper in an unsafe condition. The inventor of U.S. Pat. No. 4,143,811 states his damper design could fail in a dangerous condition.

Many of the previous damper mechanism have no fail safe feature, or incorporate one utilizing sensors, and electronic circuitry which may themselves fail at a critical time.

In my invention I have overcome these and other problems thus: by positioning the damper mechanism within the draft hood of a thermostatically controlled heating device such as a gas furnace: by making the damper larger than, and abutting the end of the flue where it leaves the draft hood: by hinging the damper at one side so that it is driven out of the flow of waste gases and high heat levels: controlling the opening and closing of the damper with the use of a control rod located underneath the damper, and pivoted from the damper centreline near the hinge. The control rod extends downwards where its other end is located in the eccentric of a cam. This control rod is designed to fail in the presence of too high an operating temperature within the draft hood, thereby removing support from the damper, forcing it open and into a safe condition. The cam is mounted on a drive shaft driven by a motor which incorporates speed reduction gearing, the cam rotates between two micro switches which through their own circuitry, being integrated with that of the gas furnace to which the mechanism is fitted, make the mechanism fully automatic and totally fail safe. The damper is hinged from a plate which is clamped by the use of two clamps to the inside of the draft hood. Fixed to the lower end of the plate are the two micro switches and the drive motor. The electronic circuitry in which is incorporated a double pole double throw relay, carries 24 V.AC. to be compatible with the gas furnace control.

In the drawings which illustrate embodiments of the invention

Figure 3:
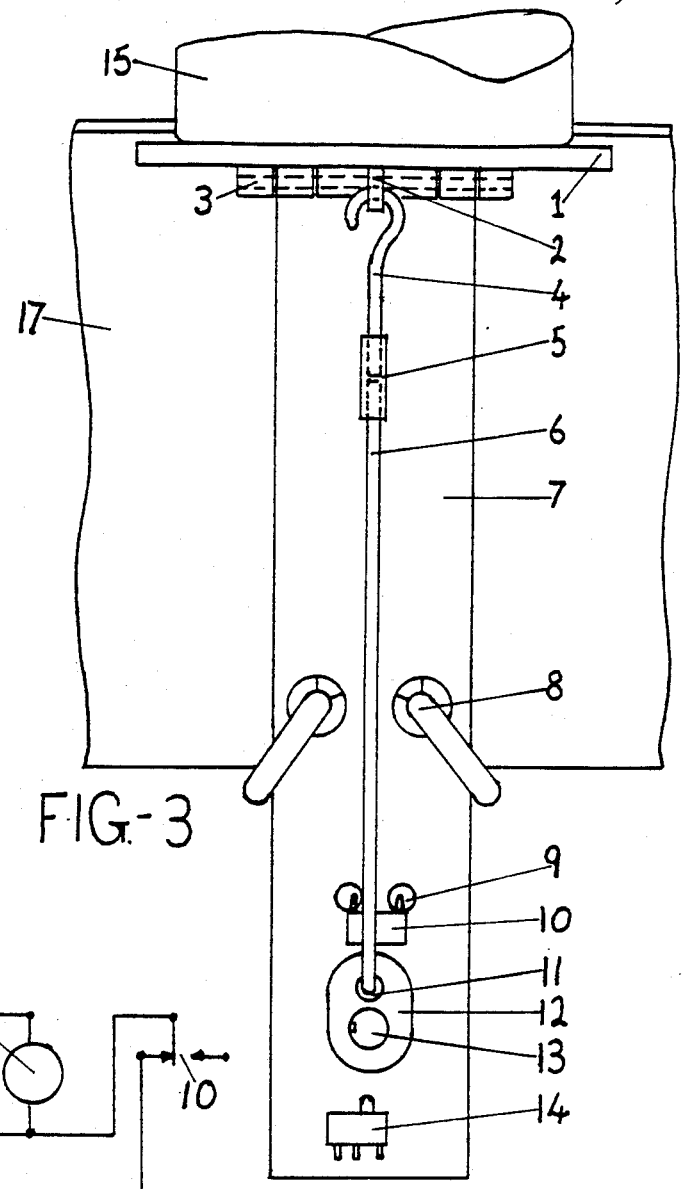
FIG. 3 is a part section of the line X—X from FIG. 1.

The mechanism illustrated comprises a damper 1 which is controllably pivoted through an arc from its fully open to its fully closed position, being pivoted about a hinge pin 3 located in the hinge formed on a chord of the damper 1 periphery. The hinge pin 3 joins the damper 1 to the assembly support plate 7 through mating hinges. The assembly support plate 7 is clamped in position to the inside of the furnace draft hood 17 by the use of the two clamps 8. In its closed position the damper 1 abutts the end of the flue 15 where the flue leaves the draft hood. The damper 1 is controllably operated by means of a control rod assembly 4,5,6 the upper section 4 seen in FIG. 3 is hooked through the control rod pivot point 2 located underneath the damper 1. The fail safe link 5 which joins together 4 and the lower section 6 into one unit. The fail safe link 5 is designed to collapse in the presence of too high an operating temperature in the draft hood, as would be created if the damper was closed while combustion was taking place in the furnace. The collapse of the fail safe link 5 forces the damper 1 open as it is no longer supported. The lower end of the control rod 6 is located in the cam 12 through a hole which is 0.007" larger in diameter than control rod 6, this is to allow for the cant developed by the action of the control rod assembly 4,5,6. The control rod 6 is held in place in the cam 12 by the use of two spring lock washers 11. The cam 12 is a push fit on the keyed drive shaft 13 which is driven through reduction gearing by the motor 18.

Figure 1:
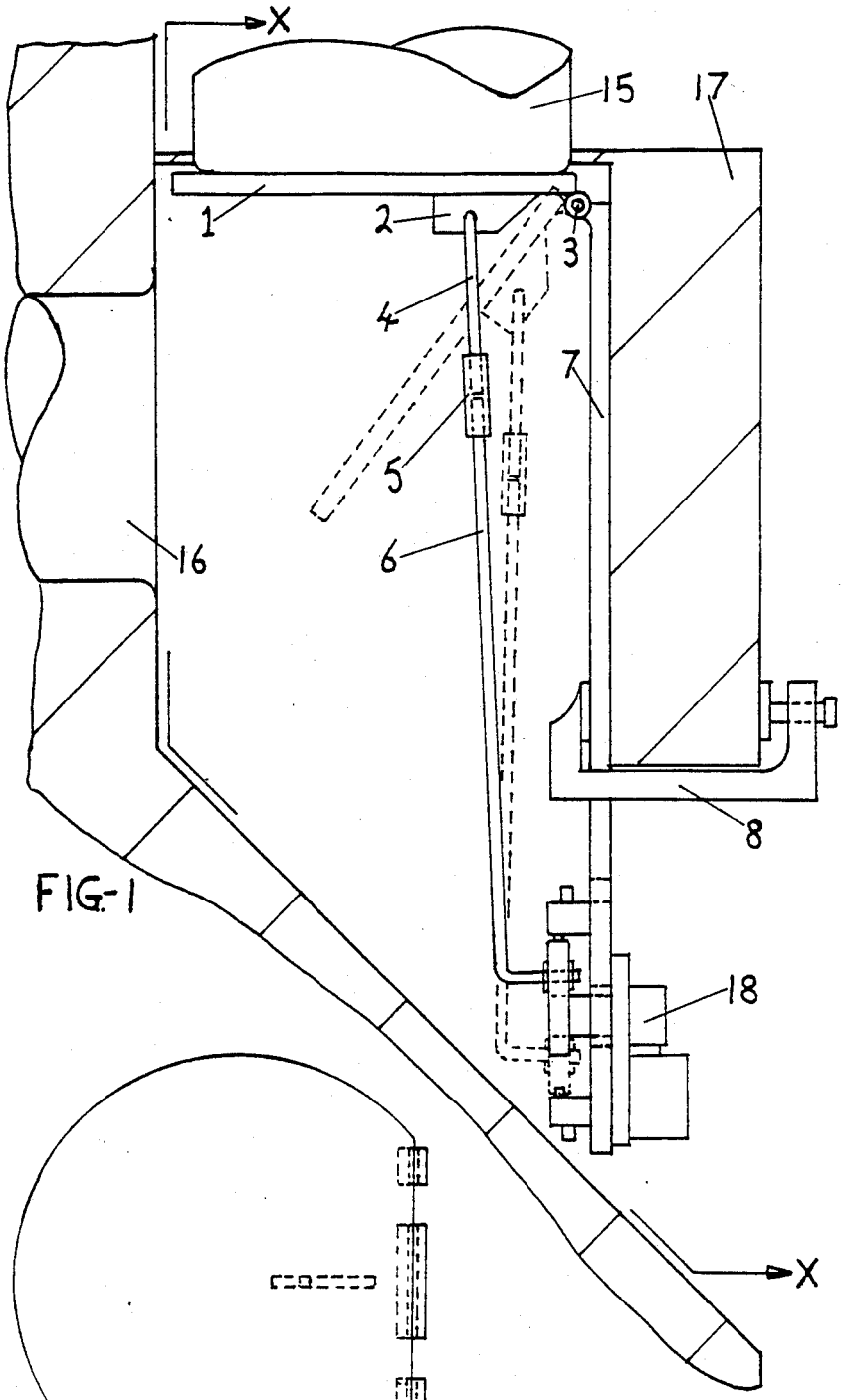
FIG. 1 is a cut away view of the draft hood of a gas furnace, showing a side elevation of the invention as fitted.
Figure 2:
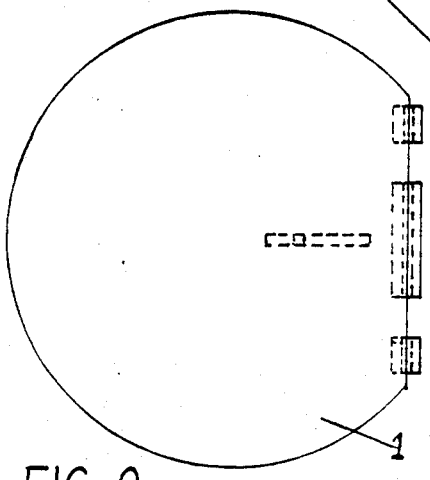
FIG. 2 is a top plan view of the damper (not fitted).

When the cam 12 is contacting the micro switch 14 the damper is fully open as depicted by the phantom lines in FIG. 1. In the open position the damper 1 is out of the flow of heat and gases leaving the furnace exhaust 16 and being drawn up the flue 15.

The operating sequence of the mechanism is as follows: starting at the damper closed position with the cam 12 having switched the normally closed micro switch 10 to the open position thereby switching the drive motor 18 off. At a signal from a thermostat 24 calling for heat the relay 19 is energised, closing the normally open contacts 20, thereby bringing power to the normally closed side of the micro switch 14 and energising the motor 18. The motor 18 drives the cam 12 through 180° where the cam 12 switches the micro switch 14 from its normally closed position to a normally open position, transferring power from the motor 18, which stops, to the gas valve terminal 23 on the furnace control box. The damper 1 now being fully open, combustion takes place. When the thermostat 24 is satisfied and switches off combustion, the relay 19 is deenergised bringing power back to the normally closed contacts 21, energising the motor 18 and starting the cam 12 rotating, which via the control rod assembly 4,5,6 closes the damper 1, the time taken for the total closure to occur being controlled by the reduction gearing incorporated in the drive motor 18 allowing all waste products to be flued away.

Figure 4:
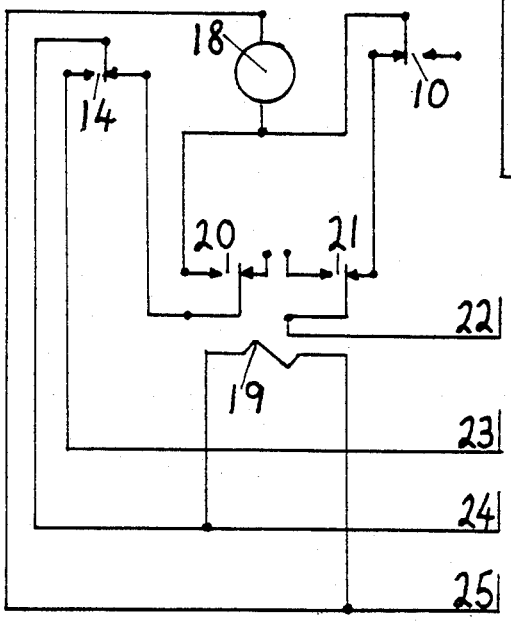
FIG. 4 is a circuit diagram for the described embodiment.

In FIG. 4 which illustrates all switches in their deenergised positions, the wire 22 is to a positive terminal on the furnace control box and the wire 25 is to a negative terminal on the furnace control box. In FIG. 3 item 9 refers to two access holes for two wires to micro switch 10. Any suitable heat resistant material may be used for construction providing that the fail safe link 5 meets the specification required for it to perform its task.

The embodiments of the invention in which an exclusive property or privilege is claimed are defined as follows:

1. A flue damper mechanism fitted to and located within the draft hood of a gas furnace or other thermostatically controlled heating device, the damper being larger than and abutting the end of the flue where it leaves the draft hood, said damper having a hinge on one edge by which means it is pivoted open and closed, the hinge of the damper being connected by a hinge pin, to hinge on a support member which is clamped to the inside of the draft hood, opening and closing of the said damper being controlled by a rod, one end of which is a second pivot that is hooked through a hole located in a flange, the flange is located underneath the damper on the damper centre line near the hinge, the control rod incorporating a safety feature, by which means it renders the damper open by a part of the control rod collapsing in the presence of too high a temperature in the draft hood, the other end of the control rod being located in the eccentric of a cam which is mounted on a shaft driven by a motor incorporating a speed reduction gear, the cam is rotated between two micro switches which are operated by the cam, and through electronic circuitry incorporating a relay and integrated with that of the furnace, or other heating device to which they are fitted, control the opening and closing of the damper.

2. A flue damper mechanism fitted to and located within the draft hood of a gas furnace or other thermostatically controlled heating device, the damper being larger than and abutting the end of the flue where it leves the draft hood, said damper having a hinge on one edge by which means it is pivoted open and closed, the hinge of the damper being connected by a hinge pin, to hinge on a support member which is clamped to the inside of the draft hood, opening and closing of said damper being controlled by a rod, one end of which is a second pivot that is hooked through a hole located in a flange, the flange is located underneath the damper on the damper centre line near the hinge, the control rod incorporating a safety feature, by which means it renders the damper open by a part of the control rod collapsing in the presence of too high a temperature in the draft hood, the other end of the control rod being located in the eccentric of a cam which is mounted on a shaft driven by a motor incorporating a speed reduction gear, the cam is rotated between two micro switches which are operated by the cam, and through electronic circuitry integrated with that of the furnace or other heating device to which they are fitted, control the opening and closing of the damper.

* * * * *